United States Patent [19]

Stoss

[11] Patent Number: 4,844,021

[45] Date of Patent: Jul. 4, 1989

[54] CLEANING DEVICE FOR HEAT EXCHANGERS HAVING TUBE BUNDLES, IN PARTICULAR FOR THE TUBE SHEET AND SPACER PLATE REGION

[75] Inventor: Johannes Stoss, Nuremberg, Fed. Rep. of Germany

[73] Assignee: Siemens Aktiengesellschaft, Munich, Fed. Rep. of Germany

[21] Appl. No.: 245,364

[22] Filed: Sep. 16, 1988

[30] Foreign Application Priority Data

Sep. 18, 1987 [DE] Fed. Rep. of Germany ... 8712637[U]

[51] Int. Cl.[4] ..... F22B 37/52

[52] U.S. Cl. ..... 122/392; 15/316 R; 122/382; 134/167 C; 165/95

[58] Field of Search ..... 122/379, 381, 382, 390, 122/391, 392; 15/316 R, 316 A, 317; 134/167 C; 165/95

[56] References Cited

U.S. PATENT DOCUMENTS

| | | | |
|---|---|---|---|
| 3,377,026 | 4/1968 | De Mart et al. | 122/391 X |
| 4,079,701 | 3/1978 | Hickman et al. . | |
| 4,273,076 | 6/1981 | Lahoda et al. . | |
| 4,276,856 | 7/1981 | Deht et al. | 122/382 |
| 4,492,187 | 1/1985 | Hammond | 122/390 |
| 4,565,206 | 1/1986 | Booij . | |
| 4,715,324 | 12/1987 | Muller et al. . | |
| 4,803,959 | 2/1989 | Sherrick et al. | 122/379 |

FOREIGN PATENT DOCUMENTS

| | | |
|---|---|---|
| 905193 | 11/1986 | Belgium . |
| 0077255 | 1/1986 | European Pat. Off. . |
| 3202248 | 8/1983 | Fed. Rep. of Germany . |
| 2551182 | 3/1985 | France . |
| 420346 | 11/1977 | Sweden . |
| 439827 | 6/1980 | Sweden . |

*Primary Examiner*—Edward G. Favors

*Attorney, Agent, or Firm*—Herbert L. Lerner; Laurence A. Greenberg

[57] ABSTRACT

A cleaning device for heat exchangers having tube bundles includes a lance with nozzles to be introduced through an opening in a heat exchanger into a tube bundle in the heat exchanger. A hollow cylinder guides the lance. A flange connected to the hollow cylinder fastens the hollow cylinder at the opening of the heat exchanger. The lance is incrementally advanced. A pivot device for moving the lance includes a motor disposed on the hollow cylinder, a pendulum gear connected to the motor, and a carrier engaging the pendulum gear. The carrier has wheels guided in longitudinal grooves formed in the lance.

6 Claims, 2 Drawing Sheets

CLEANING DEVICE FOR HEAT EXCHANGERS HAVING TUBE BUNDLES, IN PARTICULAR FOR THE TUBE SHEET AND SPACER PLATE REGION

Specification: The invention relates to a cleaning device for heat exchangers having tube bundles, especially for cleaning the tube sheet and spacer plate region, including a lance with nozzles to be introduced through an opening in the heat exchanger into the tube bundle, the lance being advanceable incrementally and being movable by means of a pivot device, and a flange having a hollow cylinder for fastening and guiding at the opening. U.S. Pat. No. 4,273,076 discloses a cleaning device that is secured at an opening of the heat exchanger by means of a mounting plate, in which a lance is guided. The lance is constructed in pinion-like fashion along the top thereof, which is acted upon by a drive in such a manner that the lance is introduced incrementally into the tube lane of the heat exchanger. The end of the lance that is introduced into the heat exchanger has a head with nozzles through which a cleaning fluid is sprayed in pulsating streams onto the tube sheet, while adhering to a fixed angle. The device is suitable for introduction into the tube lane extending in the X direction. Thus it is only by maintaining a fixed positioning angle that the cleaning stream can be aimed into the tube gap which extends 90° away from this direction.

In order to clean a heat exchanger tube sheet, it is known from German Published, Non-Prosecuted Application DE-OS 32 02 248, corresponding to U.S. Patent No. 4,572,284 to use a remote-controlled tube lane manipulator. The manipulator can be introduced into the tube lane through a service opening. The respective spraying positions of the nozzles disposed on the spray head are positionable by firmly clamping a vehicle tube in spatial conformity with externally introducible clamping feet on tubes at two opposite sides of the tube lane. The orientation of the spray nozzle orifice and its spacing from the clamping plane of the clamping feet are adapted to the tube spacing in such a way that the spray streams reach the interstices. However, due to the dimensions of the manipulator, it can only be used for the tube lane aligned in the X direction.

In the structure known from European Published, Prosecuted Application No. 0 077 255, flexible tubes disposed in band-like fashion which are introduced into the heat exchanger, are provided with spray nozzles in a fixed alignment, so that the spray nozzles aim the streams onto the tube sheet obliquely and approximately symmetrically to the direction of one tube row. The apparatus has a complicated feed mechanism, which must be mounted outside the heat exchanger and requires a large amount of surface area.

It is known from U.S. Pat. No. 4,079,701 to secure a lance at a heat exchanger opening by means of a mounting mechanism and to then introduce it into the inspection conduit. The advancement of the lance can be carried out manually or mechanically. The lance shaft is pivotable. Disposed on the head of the lance is a tube segment extending at right angles to the lance and having one nozzle on each end. Since the two nozzles direct their stream in opposite directions, it is not possible to aim both streams onto the tube sheet at the same time.

It is accordingly an object of the invention to provide a cleaning device for heat exchangers having tube bundles, in particular for the tube sheet and spacer plate region, which overcomes the hereinafore-mentioned disadvantages of the heretofore-known devices of this general type, which operates under remote control and which automatically permits uniform cleaning over the entire width of the tube sheet to the greatest extent possible.

With the foregoing and other objects in view there is provided, in accordance with the invention, a cleaning device for heat exchangers having tube bundles, in particular for the tube sheet and spacer plate region, comprising a lance with nozzles to be introduced through an opening in a heat exchanger into a tube bundle in the heat exchanger, a hollow cylinder guiding the lance, a flange connected to the hollow cylinder for fastening the hollow cylinder at the opening of the heat exchanger, means for incrementally advancing the lance, and a pivot device for moving the lance including a motor disposed on the hollow cylinder, a pendulum gear connected to the motor, and a carrier engaging the pendulum gear, the carrier having wheels guided in longitudinal grooves formed in the lance The cleaning device according to the invention is distinguished by a compact, space-saving structure, a simple pivoting device and thorough cleaning of the tube sheet. Due to the automatic pivoting, human operation is unnecessary. Furthermore, this assures uniform distribution of cleaning fluid to the plate.

In accordance with another feature of the invention, the lance has ends, and there is provided a connection head disposed on one of the ends of the lance for supplying cleaning fluid, the incremental advancing means being in the form of a guidance and feeding device disposed on the hollow cylinder parallel to the lance. This mechanically secures the part of the lance that protrudes out of the heat exchanger. In this way, mechanical movements of the lance are prevented, so that the lance cannot bend.

In accordance with a further feature of the invention, the tubes of the tube bundle have gaps therebetween with a given minimum size, and the lance, or a nozzle head of the lance carrying the nozzles, has a maximum diameter being smaller than the given minimum size. The lance can thus be introduced in the Y direction into the much narrower tube gap, so that the stream can be aimed at the plate in the X direction.

In accordance with an added feature of the invention, the lance includes two tubes and two nozzle heads each being disposed on a respective one of the tubes for carrying the nozzles, and the pivot device includes means for pivoting the tubes in mutually opposite directions This double configuration permits the flow of cleaning fluid to be doubled, which makes particularly intensive cleaning of the tube sheet possible.

In accordance with a concomitant feature of the invention, one of the tubes is driven directly by the pivot device and the other of the tubes is in torque-locking engagement with the one tube. This reduces the mechanical effort required for the pivot drive.

Other features which are considered as characteristic for the invention are set forth in the appended claims.

Although the invention is illustrated and described herein as embodied in a cleaning device for heat exchangers having tube bundles, in particular for the tube sheet and spacer plate region, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
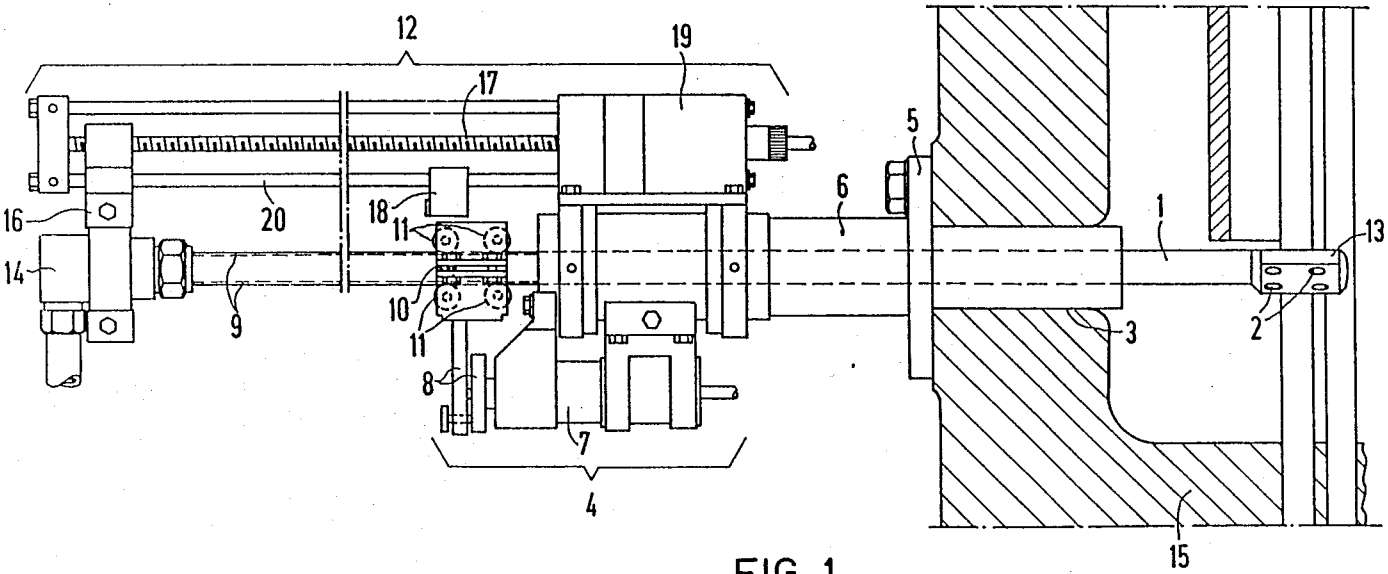
FIG. 1 is a fragmentary, diagrammatic, longitudinal-sectional view of a cleaning device.
Figure 2:
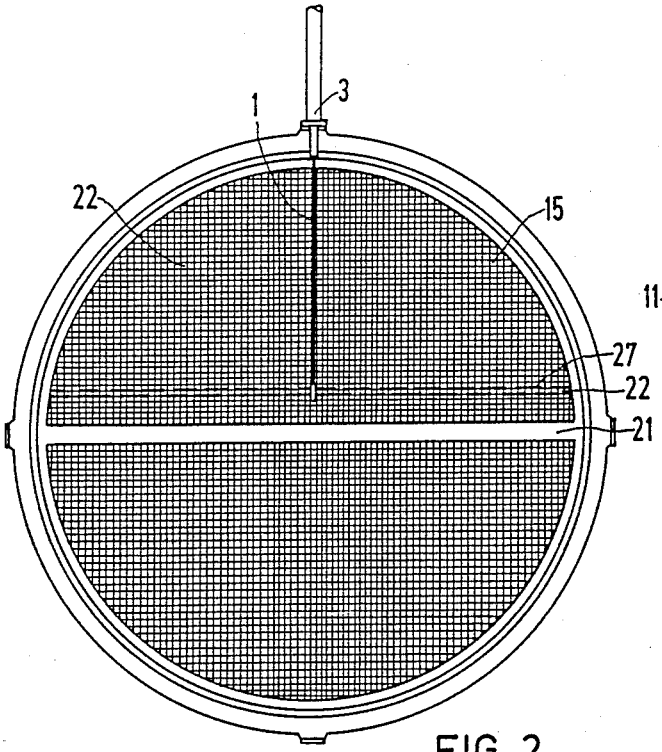
FIG. 2 is an enlarged cross-sectional view of a heat exchanger.

Referring now to the figures of the drawing in detail and first, particularly, to FIG. 1 thereof, there is seen a cleaning device according to the invention having a lance 1 which is introduced through an opening 3 (such as a hand hole) of a heat exchanger into a tube lane, as is also shown in FIG. 2. The relatively wide tube lane extends in the X direction. On the other hand, in the Y direction there are only tube gaps 22 shown in FIGS. 2 and 4 which are formed as a result of the standard spacing of the heat exchanger tubes. It can be seen from FIGS. 2, 3 and 4 that the lance 1 has been introduced into a heat exchanger plate 15 and has cleaning streams 27 which are pivoted in the X direction over the entire heat exchanger plate, bottom or floor 15.

The cleaning device shown in detail in FIG. 1 has a flange 5 screwed to the heat exchanger. The lance 1 is supported in a hollow cylinder 6. A nozzle head 13 provided on the end of the lance 1 points into the tube lane and has nozzles 2 aimed at the heat exchanger plate 15. A connection head 14 which is pivotably disposed on the opposite end of the lance 1 supplies cleaning fluid. The connection head 14 is guided by means of a holder 16 on a guidance and feeding device 12. In this way, the feeding of the lance 1 is accomplished by means of a spindle 17. The spindle 17 is driven by a feed motor 19. The guidance and feeding device 12 incrementally introduces the lance into the heat exchanger far enough so that the holder 16 comes to a stop against an end switch 18, which is adjustably disposed on a guide rail 20. The setting of the end switch 18, or the positioning thereof on the guide rail 20, defines the maximal insertion depth of the lance 1.

A pivot device 4 is disposed underneath the guidance and feeding device 12, on the other side of the hollow cylinder 6. The device 4 is substantially formed of the following units: a motor 7, a pendulum gear 8 and a carrier 10 guided by wheels 11 in longitudinal grooves 9 formed in the lance 1. The lance 1 is movably guided in the longitudinal direction in the carrier 10. The lance 1 is pivotable due to the wheels 11 engaging the longitudinal grooves 9 formed in the lance. In this way, while the lance 1 is being moved incrementally into the tube lane, the cleaning stream of the nozzle head 13 is pivoted back and forth over the heat exchanger bottom or plate 15.

Figure 3:
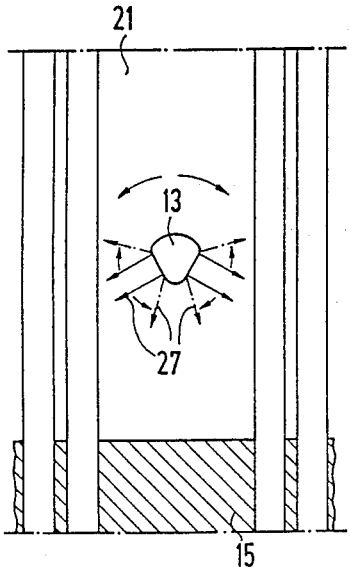
FIG. 3 is a fragmentary, cross-sectional view illustrating a nozzle pivoting angle described by a cleaning device having a nozzle head according to FIG. 2.

FIG. 3 is a cross section showing the nozzle head 13 of FIG. 1, which has been introduced into an inspection lane or corridor 21. From this figure, it is clear that with a nozzle pivot angle of only 45°, the heat exchanger plate 15 can be exposed to cleaning fluid over its entire width.

Figure 4:
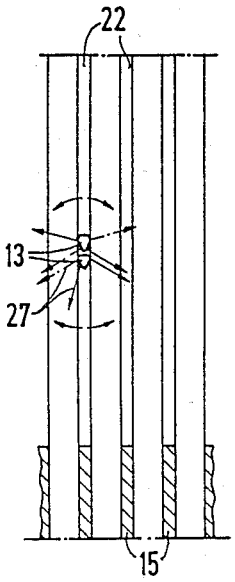
FIG. 4 is a view similar to FIG. 4 illustrating a nozzle pivoting angle described by a cleaning device having two small nozzle heads.

In FIG. 4, a lance 1 formed of two tubes has been introduced into the tube gap 22 extending in the Y direction, which is much narrower than the tube lane 21. Once again, a nozzle pivoting angle of 45° is shown. The corresponding nozzle configuration in the various nozzle heads 13 again provides a uniform intensive treatment of the heat exchanger plate 15 over its entire width, which is promoted by the contrary-pivoting streams of the individual nozzle heads.

Figure 5:
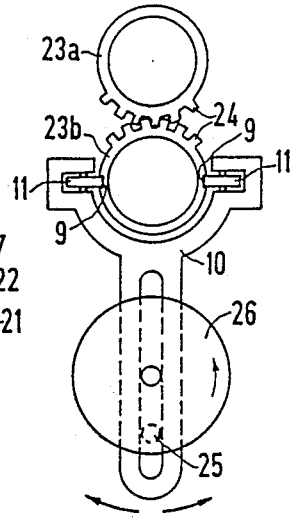
FIG. 5 is a cross-sectional view taken through the cleaning device according to FIG. 1.

FIG. 5 shows a cross section through a lance 1 formed of two tubes. The two tubes **23*a*,23*b* have teeth 24 on the peripheries thereof, so that the two tubes 23*a*, 23*b* are in torque-locking engagement with one another like gearing. The lower tube 23*b* additionally has longitudinal grooves 9 formed in the surface thereof, in which the wheels 11 of the carrier 10 are guided. The other end of the carrier 10 is moved back and forth by means of a journal 25 located on a disk 26, causing the pivoting of the tube 23*b*. Since the tube 23*a* is in torque-locking connection with the tube 23*b***, it is pivoted in the opposite direction.

The foregoing is a description corresponding in substance to German Application G 87 12 637.0, dated September 18, 1987, the International priority of which is being claimed for the instant application, and which is hereby made part of this application. Any material discrepancies between the foregoing specification and the aforementioned corresponding German application are to be resolved in favor of the latter.

I claim:

1. Cleaning device for heat exchangers having tube bundles, comprising a lance with nozzles to be introduced through an opening in a heat exchanger into a tube bundle in the heat exchanger, a hollow cylinder guiding said lance, a flange connected to said hollow cylinder for fastening said hollow cylinder at the opening of the heat exchanger, means for incrementally advancing said lance, and a pivot device for moving said lance including a motor disposed on said hollow cylinder, a pendulum gear connected to said motor, and a carrier engaging said pendulum gear, said carrier having wheels guided in longitudinal grooves formed in said lance.

2. Cleaning device according to claim 1, wherein said lance has ends, and including a connection head disposed on one of said ends of said lance for supplying cleaning fluid, said incremental advancing means being in the form of a guidance and feeding device disposed on said hollow cylinder parallel to said lance.

3. Cleaning device according to claim 1, wherein the tubes of the tube bundle have gaps therebetween with a given minimum size, and said lance has a maximum diameter being smaller than the given minimum size.

4. Cleaning device according to claim 1, wherein the tubes of the tube bundle have gaps therebetween with a given minimum size, and said lance has a nozzle head carrying said nozzles with a maximum diameter being smaller than the given minimum size.

5. Cleaning device according to claim 1, wherein said lance includes two tubes and two nozzle heads each being disposed on a respective one of said tubes for carrying said nozzles, and said pivot device includes means for pivoting said tubes in mutually opposite directions.

6. Cleaning device according to claim 5, wherein one of said tubes is driven directly by said pivot device and the other of said tubes is in torque-locking engagement with said one tube.

* * * * *